US012543918B2

(12) United States Patent
Johansson et al.

(10) Patent No.: US 12,543,918 B2
(45) Date of Patent: Feb. 10, 2026

(54) HOUSEHOLD APPLIANCE

(71) Applicant: Gorenje d.o.o., Velenje (SI)

(72) Inventors: Mikael Johansson, Götene (SE); Adrian Pauli, Vinninga (SE)

(73) Assignee: Gorenje d.o.o., Velenje (SI)

( * ) Notice: Subject to any disclaimer, the term of this patent is extended or adjusted under 35 U.S.C. 154(b) by 16 days.

(21) Appl. No.: 18/694,794

(22) PCT Filed: Sep. 27, 2022

(86) PCT No.: PCT/EP2022/076801
§ 371 (c)(1),
(2) Date: Mar. 22, 2024

(87) PCT Pub. No.: WO2023/046981
PCT Pub. Date: Mar. 30, 2023

(65) Prior Publication Data

US 2024/0398204 A1 Dec. 5, 2024

(30) Foreign Application Priority Data

Sep. 27, 2021 (SE) ..... 2151177-9

(51) Int. Cl.
*A47L 15/42* (2006.01)
*A47L 15/46* (2006.01)

(52) U.S. Cl.
CPC ..... *A47L 15/4242* (2013.01); *A47L 15/4219* (2013.01); *A47L 15/46* (2013.01); *A47L 2401/10* (2013.01); *A47L 2601/10* (2013.01)

(58) Field of Classification Search
CPC ..... A47L 15/0015; A47L 15/4219; A47L 15/4242; A47L 15/46; A47L 2401/10; A47L 2601/10
See application file for complete search history.

(56) References Cited

U.S. PATENT DOCUMENTS

2007/0034239 A1 2/2007 Park et al.
2014/0060590 A1* 3/2014 Aras ..... A47L 15/4208 134/111

(Continued)

FOREIGN PATENT DOCUMENTS

CN 211797808 U 10/2020
DE 102010038692 A1 * 2/2012 ..... A47L 15/4242

(Continued)

OTHER PUBLICATIONS

Machine translation of DE102018222307A1 (Year: 2020).*

(Continued)

*Primary Examiner* — Douglas Lee
(74) *Attorney, Agent, or Firm* — MARSHALL, GERSTEIN & BORUN LLP

(57) ABSTRACT

The invention concerns a household appliance, the household appliance comprising: a washing chamber for washing of items to be cleaned; a water system configured to feed water to and from the washing chamber for cleaning and/or rinsing of the items therein; wherein the water system comprises a UV-treatment chamber for disinfection and/or sterilization of water to be fed to the washing chamber during operation of the household appliance, wherein the UV-treatment chamber is provided with at least a first UV-light source arranged to direct UV-light towards water present in the UV-treatment chamber. The UV-treatment chamber is further provided with at least a first UV-light reflector. The invention also concerns a method for operating a household appliance.

17 Claims, 8 Drawing Sheets

(56) References Cited

U.S. PATENT DOCUMENTS

| | | | | |
|---|---|---|---|---|
| 2015/0284266 | A1 | 10/2015 | Matsui | |
| 2018/0008116 | A1* | 1/2018 | Durham | A47L 15/0031 |
| 2019/0047877 | A1* | 2/2019 | Geboers | E03C 1/046 |
| 2019/0135659 | A1* | 5/2019 | Smetona | C02F 1/008 |

FOREIGN PATENT DOCUMENTS

| | | | | |
|---|---|---|---|---|
| DE | 102017112460 | A1 | 1/2018 | |
| DE | 102018222307 | A1 * | 6/2020 | A47L 15/4242 |
| EP | 1925709 | A1 | 5/2008 | |
| EP | 3140449 | A1 | 3/2017 | |
| KR | 100832116 | B1 * | 5/2008 | A23N 12/023 |
| KR | 20170094511 | A | 8/2017 | |

OTHER PUBLICATIONS

Machine translation of DE102010038692A1 (Year: 2012).*
Machine translation of KR100832116B1 (Year: 2008).*
International Search Report and Written Opinion for Application No. PCT/EP2022/076801, dated Jan. 2, 2023.
Swedish Search Report for application No. 2151177-9, dated Sep. 27, 2021.

* cited by examiner

HOUSEHOLD APPLIANCE

TECHNICAL FIELD

This invention relates to a household appliance comprising a UV-treatment chamber for disinfection and/or sterilization of water to be fed to a washing chamber of the household appliance during operation of the household appliance. The invention also relates to a method for operating the household appliance.

BACKGROUND OF THE INVENTION

Household appliances, such as dishwasher and laundry machines, are sometimes provided with arrangements for disinfection of the process water. Although it has been known for long that, for instance, UV-light, ozone and heat can be used to inactivate and destroy microorganisms, dishwashers or laundry machines that provides for efficient disinfection without being too costly to purchase or operate are rare on the market.

As to UV the experience is that a very high power of the UV source is needed to achieve a sufficient disinfecting effect, which leads to rather costly UV sources and to increased operational costs. As to ozone and other chemical treatment, effect and cost have also been a challenge, and also safety issues. As to heat, the temperature required for efficient disinfection may destroy the items to be washed.

There is thus a need for improvements in the field of disinfection of process water in household appliances of the above type.

SUMMARY OF THE INVENTION

An object of this invention is to provide a household appliance that provides for improved disinfection properties compared to conventional household appliances. This object is achieved by the household appliance and method defined in the corresponding independent claims. The dependent claims contain advantageous embodiments, further developments and variants of the invention.

The invention concerns a household appliance comprising: a washing chamber for washing of items to be cleaned; a water system configured to feed water to and from the washing chamber for cleaning and/or rinsing of the items therein; wherein the water system comprises a UV-treatment chamber for disinfection and/or sterilization of water to be fed to the washing chamber during operation of the household appliance, and wherein the UV-treatment chamber is provided with at least a first UV-light source arranged to direct UV-light towards water present in the UV-treatment chamber. Further, the UV-treatment chamber is provided with at least a first UV-light reflector.

The household appliance may be a dishwasher or a laundry machine. Normally there is not room for large water treatment chambers in such household appliances and in a conventional household appliance with a UV-treatment chamber a significant portion of the emitted UV-light therefore passes straight through the water to be treated without interaction and strikes the inner wall of the treatment chamber. Since water conduits in household appliances typically are made of PVC, PP or similar plastics that absorb UV-light, this portion of the UV-light will be absorbed without contributing to any disinfection/sterilization treatment. By the inventive use of UV-light reflectors, this portion of UV-light is instead allowed to be reflected back into the treatment chamber for use in inactivating and destroying microorganisms in the water. Thus, the UV-light source can be used more efficiently and the UV-source power needed for achieving a certain level of water disinfection/sterilization treatment can be reduced.

The term "UV-light reflector" means that the reflector has the property of reflecting at least 10% of normal incidence UV-light of at least some of the wavelengths within a range of 100-280 nm (UV-C).

In principle, the UV-treatment chamber may be made of, or the inner wall of the UV-treatment chamber may be entirely covered with, a UV-reflecting material, such as aluminium, Teflon (polytetrafluoroethylene, PTFE), chrome, rhodium and/or stainless steel. However, due to material costs and risk of degradation (as an example, aluminium is relatively quickly degraded if contacted with an aqueous solution with high pH, such as process water in a dishwasher machine), it is an advantage to produce the treatment chamber in a UV-resistant material, such as PVC, PP and some other plastics, use a relatively small piece of UV-reflecting material, position the reflector geometrically adequate in relation to the source and the direction of the UV-light, and, if the reflector material is sensitive, arrange the UV-light reflector behind a protective layer of a UV-transparent material. Also the UV-light source is preferably arranged behind a protective layer of a UV-transparent material.

In an embodiment, the first UV-light source is arranged to direct UV-light towards the first UV-light reflector, wherein the first UV-light source and the first UV-light reflector are arranged in relation to each other so that, when UV-light is emitted from the first UV-light source and water is present in the UV-treatment chamber, the UV-light from the first UV-light source passes through water in the UV-treatment chamber before striking the first UV-light reflector, and wherein the first UV-light reflector is arranged so that the UV-light from the first UV-light source striking the first UV-light reflector is reflected into the water present in the UV-treatment chamber.

In an embodiment, the first UV-light source is arranged in association with a first opening in a wall of the UV-treatment chamber, wherein the first opening is provided with a first sealed cover that at least partly is made of a UV-transparent material and that has an inner side facing the UV-treatment chamber and an outer side facing away from the UV-treatment chamber, wherein at least a part of the first sealed cover exhibits a UV-transparent zone, and wherein the first UV-light source is arranged on an outside of the first sealed cover and directed towards the UV-treatment chamber so as to direct the UV-light through the UV-transparent zone and into the UV-treatment chamber.

The first cover may be made in its entirety of a UV-transparent material, such as quartz glass, and may have a flat form and be arranged as a sealed window covering the first opening. The UV-transparent zone allows UV-light to enter the treatment chamber through the cover even if some portion of the UV-transparent area is covered by a material that absorbs or reflects UV-light.

In an embodiment, the first UV-light reflector is arranged in association with a second opening in a wall of the UV-treatment chamber, wherein the second opening is provided with a second sealed cover.

The first UV-light reflector may be attached to the inner or outer side of the second sealed cover so as to be properly installed when the second sealed cover is installed.

In an embodiment, the first UV-light reflector is arranged on an inside of the second sealed cover so as to reflect UV-light before it reaches the second sealed cover. The reflector is thus in this case located inside the UV-treatment chamber. This is suitable for e.g. Teflon that is not prone to degrade.

In an embodiment, the second sealed cover is at least partly made of a UV-transparent material, and wherein the first UV-light reflector is arranged on an outside of the UV-transparent material so as to allow UV-light directed towards the second opening to pass through the UV-transparent material, reflect onto the first UV-light reflector and pass back through the UV-transparent material into the UV-treatment chamber. The second cover may be structured in a similar way as the first cover as described above. The UV-light reflector, for instance in the form of an thin film of aluminium (that is more sensitive than Teflon), may be applied directly onto the UV-transparent material or may be arranged at a distance therefrom.

Irrespective of whether the UV-light reflector is arranged on the inside or the outside of the transparent material, the reflector may have a flat shape or may have a bent shape to reflect the incoming UV-light in a particular way. An inner and/or outer side of the second cover may have a bent shape that sets the shape of the UV-light reflector, for instance by applying a thin sheet of aluminium to the outer side or a this sheet of Teflon on the inner side.

Applying the reflector material, such as Teflon or aluminium, directly onto the cover, that may be made of quartz, increases the strength of the combined component, e.g. a quartz plate provided with a layer of Teflon or Al. The total amount of material may then be reduced.

The UV-treatment chamber may be provided with several openings and a plurality of both UV-light sources and UV-light reflectors.

In an embodiment, the UV-treatment chamber is provided with a second UV-light reflector in addition to the first UV-light reflector, wherein the second UV-light reflector is arranged in association with the first UV-light source at the first opening, and wherein the second UV-light reflector is arranged on the outside or an inside of the UV-transparent material of the first sealed cover around or at a side of the UV-transparent zone so as to, while still allowing UV-light from the first UV-light source to pass through the UV-transparent zone and into the UV-treatment chamber, allow UV-light directed towards the first opening to be reflected back into the UV-treatment chamber.

If the second UV-light reflector is arranged on the outside of the UV-transparent material, the UV-light is allowed to pass through the UV-transparent material, reflect onto the second UV-light reflector and pass back through the UV-transparent material into the UV-treatment chamber. On the other hand, if the second UV-light reflector is arranged on the inside of the UV-transparent material, the UV-light is allowed to be reflected before it reaches the UV-transparent material.

In this embodiment the first UV-light source and the second UV-light reflector thus form a combined UV source and reflector unit that further may include also the UV-transparent material and the cover (and a seal for sealing the cover when the cover is attached to the opening).

Further, in this embodiment the second UV-light reflector may define the UV-transparent zone, for instance by letting the second UV-light reflector cover more or less the entire first cover (or at least the UV-transparent material thereof) and providing an opening in the second UV-light reflector that forms the UV-transparent zone.

Besides being applied onto (the UV-transparent material of the) first cover, the second UV-light reflector, if arranged on the outside of the first cover, may be arranged onto a carrier used for carrying the first UV-light source, i.e. a UV-reflecting layer may be arranged onto said carrier around the first UV-light source or the carrier may be made of a UV-reflecting material. In this embodiment with the combined UV source and reflector unit, the UV-treatment chamber preferably is provided with a second UV-light source arranged to direct UV-light towards the first opening. That second UV-light source may be arranged in association with the first UV-light reflector at the second opening in a similar way as the first UV-light source and the second UV-light reflector are arranged at the first opening. The UV-treatment chamber may be provided with further UV-light sources and reflectors.

In an embodiment, the UV-light reflector is made of aluminium, preferably a thin layer of aluminium, such as an aluminium foil.

In an embodiment, the UV-light reflector is made of Teflon, preferably a thin layer of Teflon, such as a Teflon foil.

As mentioned above, Teflon is not likely to degrade and is generally a better choice than aluminium if the reflector is to positioned in contact with the water to be treated, such as if arranged on the inside of the cover. Further, Teflon does not conduct electricity and may therefore have further advantages compared to aluminium depending on the particular application. If the household appliance is provided with several UV-light reflectors it is possible to use different reflector material for different reflectors. An individual reflector may comprise more than one reflecting material.

In an embodiment, the UV-transparent material is quartz glass. Certain silicon-based materials may also be possible to use.

In an embodiment, the UV-light source is configured to emit UV-light within a range that at least partly includes wavelengths between 100-280 nm (UV-C). Longer wavelengths may be included in the spectrum but relatively short wavelengths are needed for efficient disinfection.

In an embodiment, the UV-treatment chamber forms a through-flow conduit for water.

In an embodiment, the first UV-light source is arranged at a wall of the UV-treatment chamber so as to direct UV-light into the UV-treatment chamber in a direction across a flow direction of the water when water flows through the UV-treatment chamber.

In an embodiment, also the first UV-light reflector is arranged at the wall of the UV-treatment chamber but displaced in relation to the first UV-light source with regard to a circumference of the UV-treatment chamber so that, when UV-light is emitted from the first UV-light source and water flows through the UV-treatment chamber, the UV-light from the first UV-light source passes through the water across the flow direction thereof before striking the first UV-light reflector.

As an example, the first UV-light source and the first UV-light reflector may be aligned with each other in relation to an axial direction of the UV-treatment chamber and may be arranged on opposite sides of the chamber so that the UV-light passes through a center point of the UV-treatment chamber (if the chamber is symmetric) and in a direction strictly perpendicular to the flow direction of the water before reaching the first UV-light reflector. Various variations are, however, possible; for instance, three source/reflector units may be evenly distributed along a (circular) circumference of a pipe-shaped UV-treatment chamber, i.e. with 120° separation. The UV-sources can be arranged to spread the UV-light in a wide cone so that the UV-light from each of the sources hits both of the two other source/reflector units. Further variations are that the source and the reflector do not necessarily have to be axially aligned and they do not necessarily have to be arranged on opposite sides so the UV-light does not necessarily have to pass through a center point of the chamber. The UV-light reflector may be arranged to reflect the incident UV-light in the opposite direction towards the source or in another direction depending on the design or inclination of the reflector. By providing the reflector with a bent surface it is also possible to spread out or focus the reflected UV-light in various ways.

In an embodiment, the water system comprises a recirculation system for recirculating of water to be fed to the washing chamber during operation of the household appliance, wherein the UV-treatment chamber is arranged in said recirculation system.

In an embodiment, the circulation system is arranged to recirculate water from the washing chamber and back to the washing chamber.

The UV-treatment chamber is thus in this embodiment used for treating water that is recirculated in a loop including the washing chamber. Such a loop is commonly used in dishwashers and laundry machines both for cleaning and for rinsing. The UV-light source is preferably used during a rinsing stage of the process since the process water during cleaning typically contains large amounts of species that absorb UV-light, such as dirt and detergent. As further described below, a turbidity sensor may be used to determine whether the UV-light source should be activated or not; if the turbidity is above a certain threshold, the UV-light source may be turned off, and optionally, the recirculating water may be discharged and replaced.

In an embodiment, the water system comprises a tank for storage of incoming fresh water and/or water coming from the washing chamber, wherein the recirculation system is arranged to recirculate water from the tank and back to the tank.

Such a tank may be connected to a fresh water inlet and to the washing chamber to allow storage of fresh water and/or rinsing water from the washing chamber ("grey water"). The water in the tank can thus be treated in the UV-treatment chamber arranged in the tank recirculation system. This is of particular interest where the supply of freshwater may not be sufficiently fresh and thus preferably is subject to UV-treatment before being introduced into the washing chamber. Also the water recirculating through the washing chamber and back into the tank can be treated. In a variant, the fresh water inlet is the only main water inlet to the tank, i.e. water from the washing chamber is not intended to be fed to the tank, so the main purpose of the tank in this variant is to form a reservoir of fresh water for the household appliance. The recirculation system, where the UV-treatment is located, is then used for treating only fresh water to be used in the household appliance.

It is possible to have more than one UV-treatment chamber, e.g. a first UV-treatment chamber arranged in a water recirculation system including the washing chamber and a second UV-treatment chamber arranged in a fresh water storage tank recirculation system.

In an embodiment, the household appliance comprises a fresh water inlet and an outlet for used water, both of which being connected to the water system.

In an embodiment, the household appliance is a dishwasher machine.

In an embodiment, the household appliance is provided with a turbidity sensor arranged to sense a turbidity of water present, or water to be present or water that has been present, in the UV-treatment chamber during operation of the household appliance.

The turbidity sensor may thus be arranged in the UV-treatment chamber or upstream that chamber in a conduit or container where water is present before it reaches the UV-treatment chamber, such as in the drain of the washing chamber. The sensor may also be arranged downstream the UV-treatment chamber.

The household appliance further comprises a control unit for controlling the operation of the appliance, such as controlling pumps and valves for cleaning and rinsing depending on operation program selected, controlling discharge of detergent, switching on and off the UV-light sources, etc. The control unit is further connected to various sensors, including the turbidity sensor, and configured to control the operation depending on input from e.g. the turbidity sensor.

The household appliance may be arranged so that the UV-light source may be activated by the control unit during any stage of the washing cycle by default in the selected washing program or by user interaction (i.e. the uses selects "UV-mode" or similar). As mentioned above, UV-light treatment is preferably used during final rinse process steps.

The invention also concerns a method for operating a household appliance of the above type. The method comprising: operating the household appliance with the first UV-light source activated; receiving a signal from the turbidity sensor; determining, based on the turbidity sensor signal, whether the turbidity is above a threshold; and if the turbidity is above the threshold:

deactivating the first UV-light source and/or control the water system so as to lower the turbidity in the water present or to be present in the UV-treatment chamber.

An example of this method is where the UV-treatment chamber is arranged in a recirculation system of water from and to the washing chamber; if the turbidity gets too high, the UV-light source is turned off and at least a portion of the recirculating water is discharged from the appliance and replaced by fresh water. The UV-light source may be activated again when the turbidity falls below the threshold.

BRIEF DESCRIPTION OF DRAWINGS

In the description of the invention given below reference is made to the following figure, in which.

DESCRIPTION OF EXAMPLE EMBODIMENTS OF THE INVENTION

Figure 1:
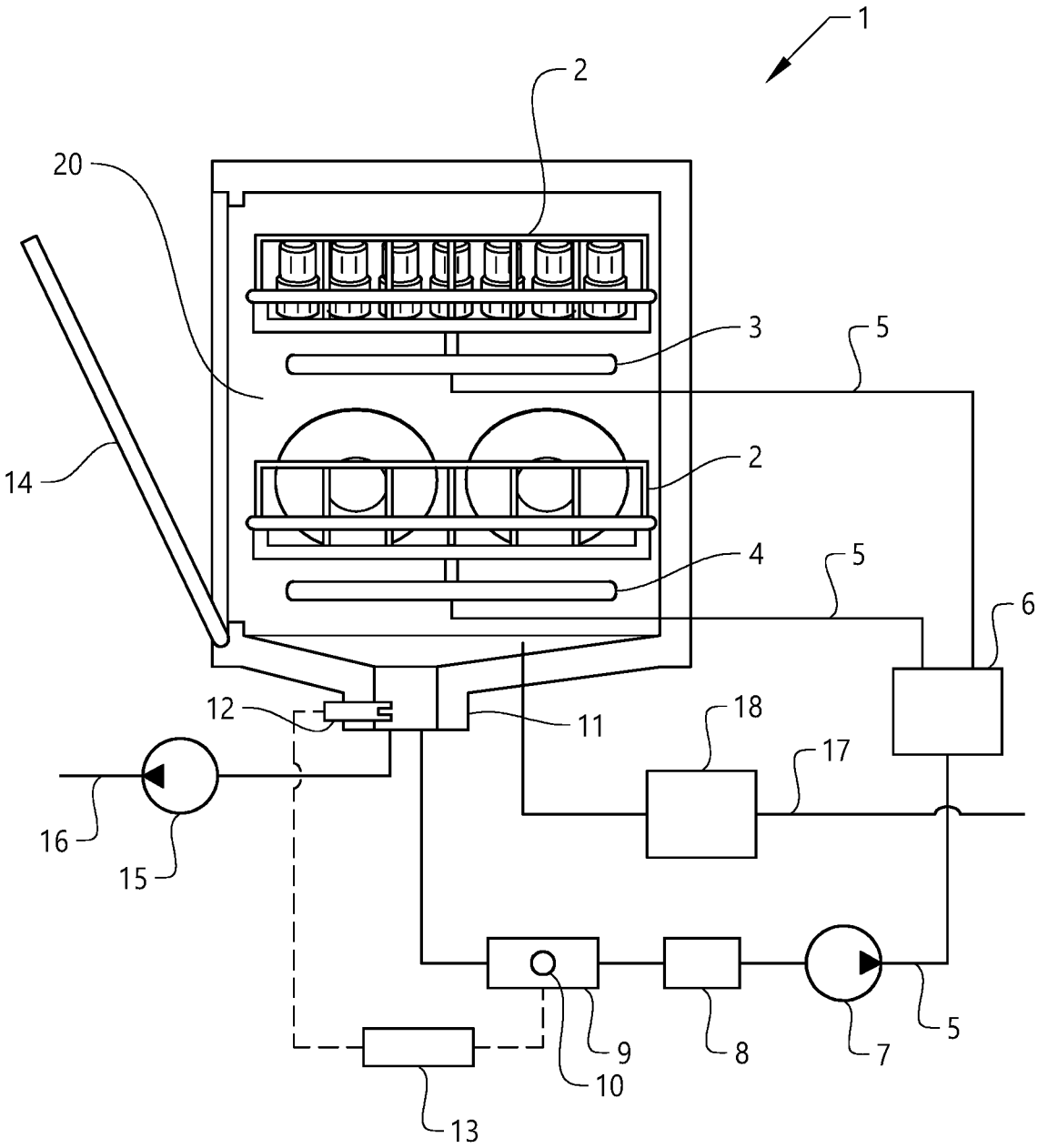
FIG. 1 shows a first embodiment of a household appliance according to this disclosure.

FIG. 1 shows a first embodiment of a household appliance in the form of a dishwasher 1 comprising a (dish) washing chamber 20 that can be closed by a door 14. Upper and lower baskets 2 and upper and lower spray arms 3, 4 are arranged inside the washing chamber 20.

The dishwasher 1 further comprises water conducting pipes 5, a diverter 6, a recirculation pump 7, a heater 8, a UV-treatment chamber 9 with a UV light source 10 indicated, a filter bottom (sump) 11, a turbidity sensor 12, a control unit 13, a drain pump 15, a drain connection (main outlet) 16, tap/fresh water connection (main inlet) 17 and a water intake/inlet system 18 comprising e.g. a valve and an airbrake softener. As can be understood when studying this disclosure, all these parts are not necessary for the invention.

The dishwasher 1 thus comprises a water system configured to feed water to and from the washing chamber 20 for cleaning and/or rinsing of the items therein. This water system includes the tap/fresh water connection 17 arranged (in this example) to feed water directly to a bottom part of the washing chamber 20 and it also includes a recirculation system driven by the recirculation pump 7. In the recirculation system, water is recirculated through the water conducting pipes 5 from the sump 11, via/through the UV-treatment chamber 9 and the heater 8 to the recirculation pump 7, and further to the diverter 6 and spray arms 3, 4 back to the washing chamber 20 (and down to the sump 11).

As indicated in FIG. 1, the control unit 13 is arranged to receive signals from the turbidity sensor 12 and to control the UV light source 10. The control unit 13 is also configured to control other components of the dishwasher 1, such as the pumps 7, 15, the heater 8 and the valve in the water intake/inlet system 18, so as to control the normal operation of the dishwasher 1.

A method for operating the dishwasher 1 may comprise:

operating the dishwasher 1 with the UV-light source 10 activated;

receiving, by the control unit 13, a signal from the turbidity sensor 12;

determining, by the control unit 13, based on the turbidity sensor signal, whether the turbidity is above a threshold; and if the turbidity is above the threshold:

deactivating, using the control unit 13, the UV-light source 10 and/or controlling the water system so as to lower the turbidity in the water present or to be present in the UV-treatment chamber 9.

Lowering the turbidity in the water present in the recirculation system, i.e. for instance in the sump 11, can be achieved by discharging at least a portion of the recirculating water from the dishwasher 1 using the drain pump 15 and replacing that water with fresh water using the valve in the water intake/inlet system 18. The UV-light source 10 may be activated again when the turbidity falls below the threshold.

Figure 2:
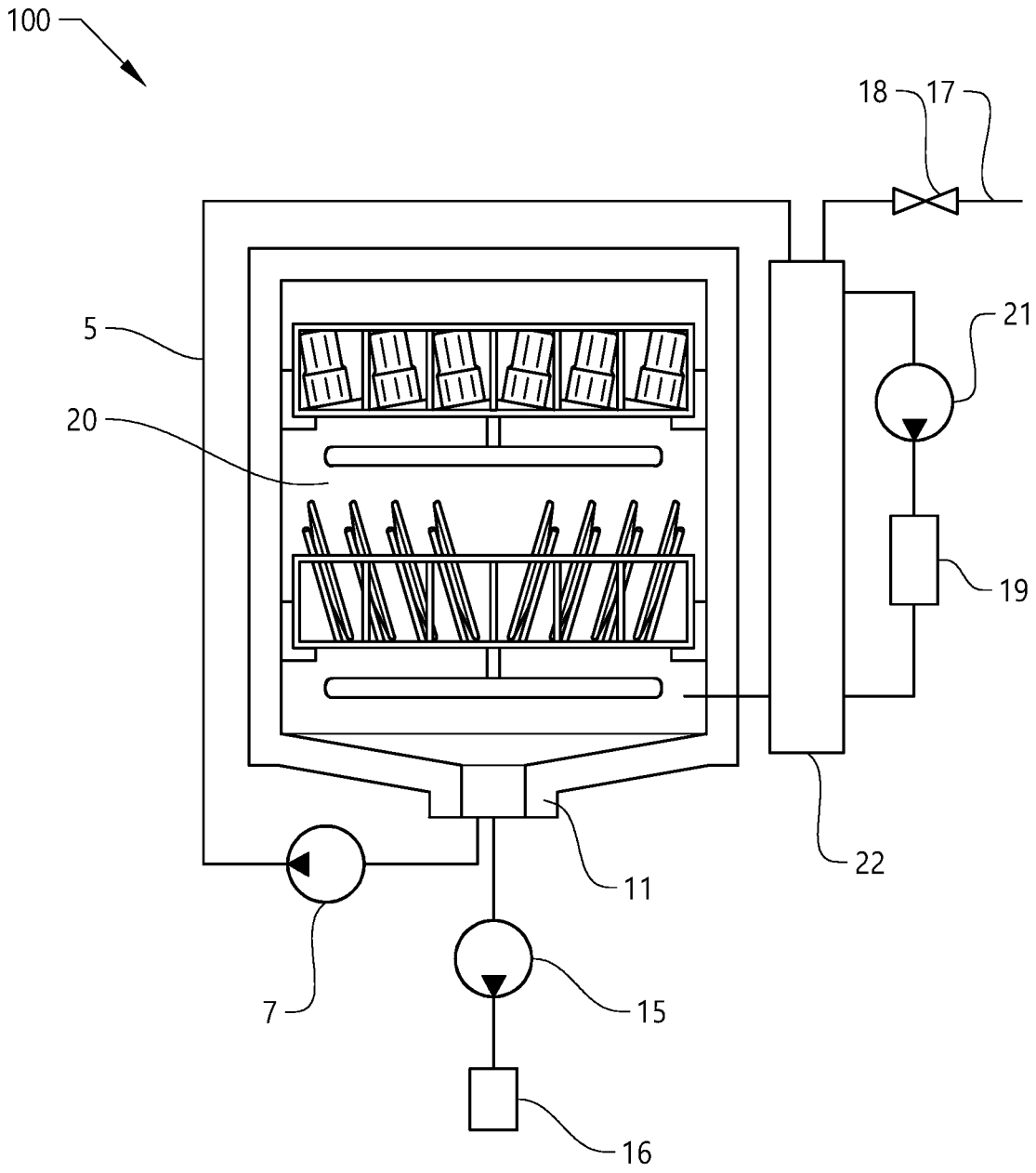
FIG. 2 shows a second embodiment of a household appliance according to this disclosure.
Figure 3A:
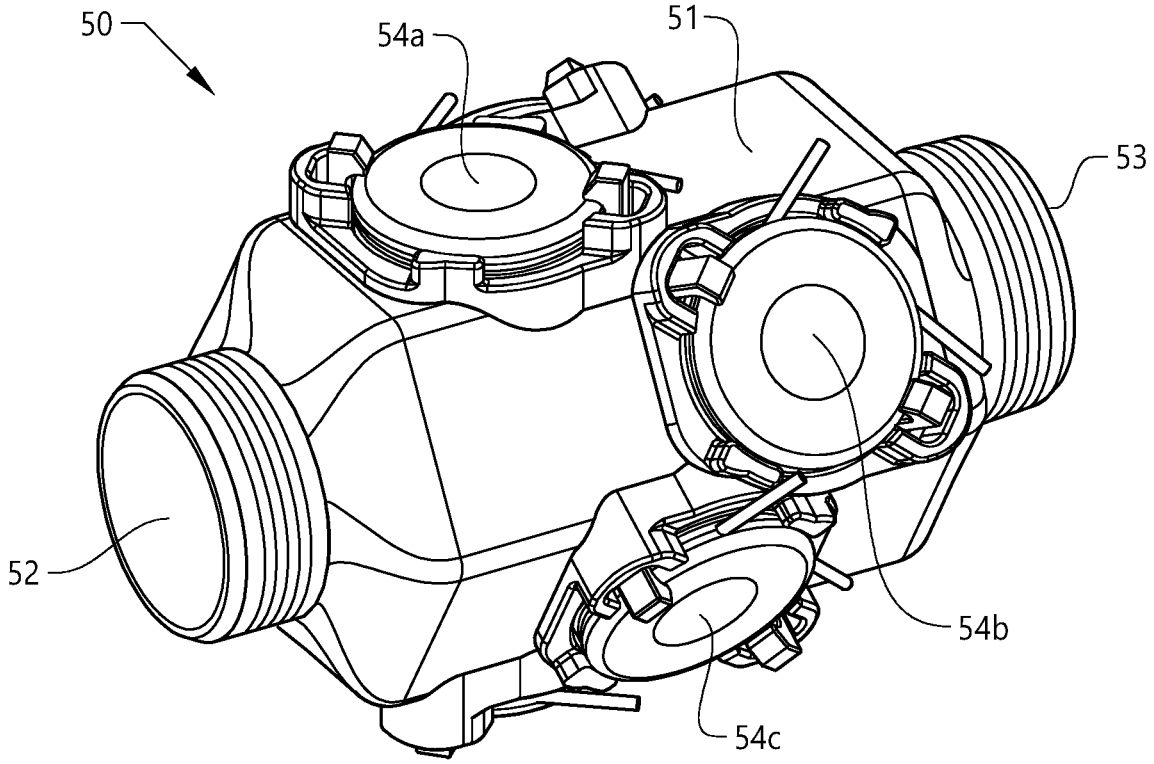
FIGS. 3A, 3B, 4, 5 and 6 show a first embodiment of a UV-treatment chamber according to this disclosure.
Figure 3B:
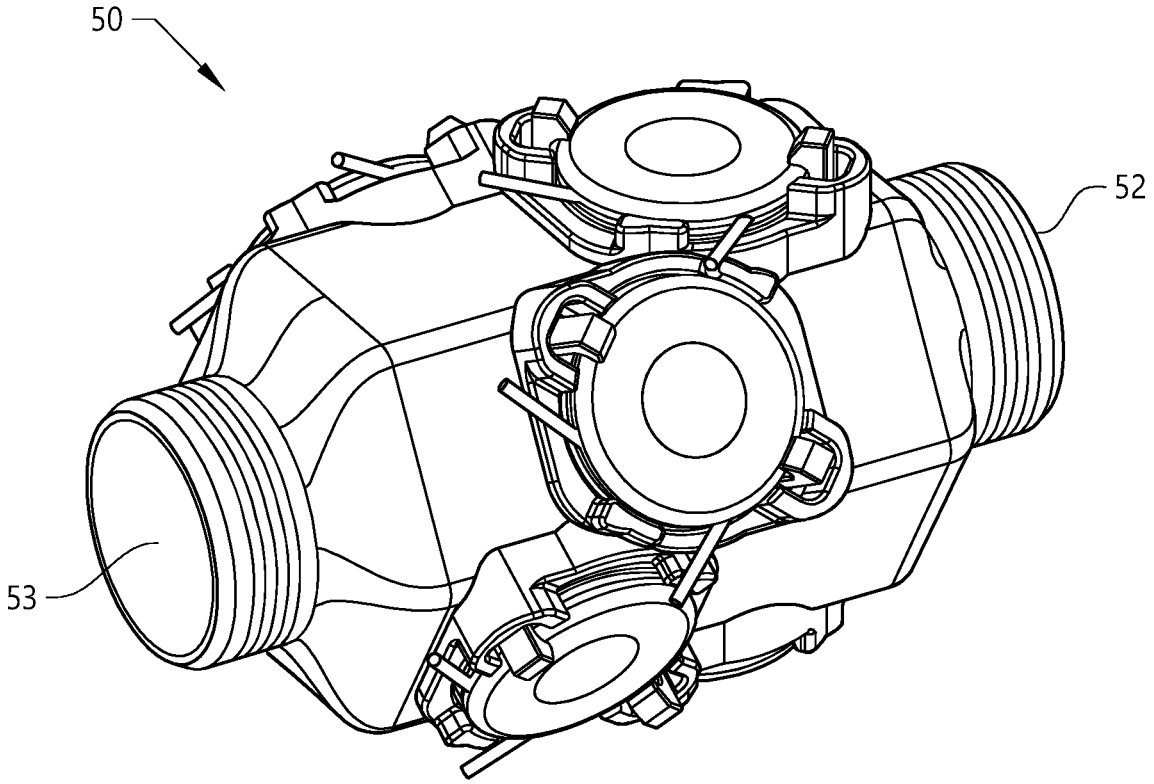

FIG. 2 shows a second embodiment of a household appliance according to this disclosure. The appliance of FIG. 2 is also a dishwasher 100 that is similar to the dishwasher 1 of FIG. 1 but illustrated in a more simplified manner. The principal structure and function of the dishwasher 100 of FIG. 2 is similar to the dishwasher 1 of FIG. 1 and similar components have therefore been given the same reference numbers. Also the dishwasher 100 in FIG. 2 is provided with a control unit (not shown) for controlling various components and operation of the dishwasher 100.

What mainly differs between the dishwashers 1, 100 in FIGS. 1 and 2 is that the dishwasher 100 in FIG. 2 is provided with a tap/fresh water tank 22 and that a UV-treatment chamber 19, together with a pump 21, is arranged in a recirculation system connected to the water tank 22. Water present in the water tank 22 may thus be recirculated using the pump 21 so as to be treated in the UV-treatment chamber 19 and fed back to the water tank 22.

FIG. 2 indicates that the water recirculated from and to the washing chamber 20 via the pipes 5 is fed via the water tank 22 so as to mix with any tap/fresh water present there. An alternative is to arrange a separation plate inside the water tank 22, or arrange a separate tank or flow path for the water recirculating from and to the washing chamber 20, so that only tap/fresh water is allowed to enter the water tank 22. This is particularly suitable when it is desired to disinfect the tap/fresh water before it is allowed to be fed further to the washing chamber 20 of the dishwasher 100.

The dishwasher 100 may be provided with an additional UV-treatment chamber somewhere in the recirculation system, i.e. somewhere in the water conducting pipes 5, in line with what is described in relation to FIG. 1.

Each of the schematically illustrated UV-treatment chambers 9, 19 in FIGS. 1 and 2 comprises at least a first UV-light source and at least a first UV-light reflector that may be arranged in different ways.

FIGS. 3A, 3B, 4, 5 and 6 show a first embodiment of a UV-treatment chamber 50 according to this disclosure. In this example the UV-treatment chamber 50 has a water inlet 52, a water outlet 53 and a chamber body 51 through which water flows during operation of the dishwasher 1, 100 (or at least during operation of the recirculation pumps 7 and 21). The chamber body 51 has a hexagonal cross section and is provided with six UV source/reflector units 54*a*-54*f* arranged in pairs on opposite sides of the hexagonal chamber body 51 (see FIG. 6).

Figure 4:
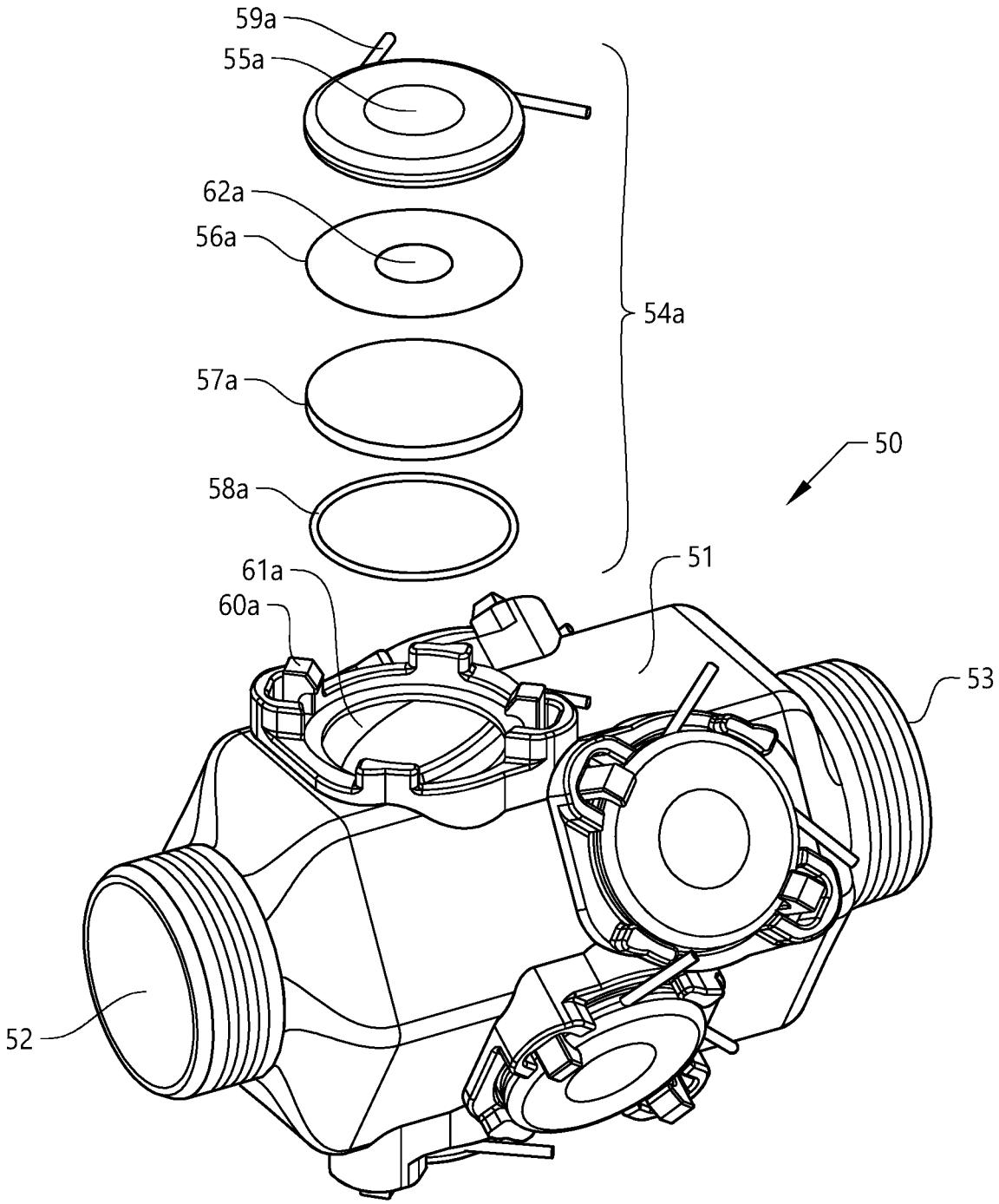
Figure 5:
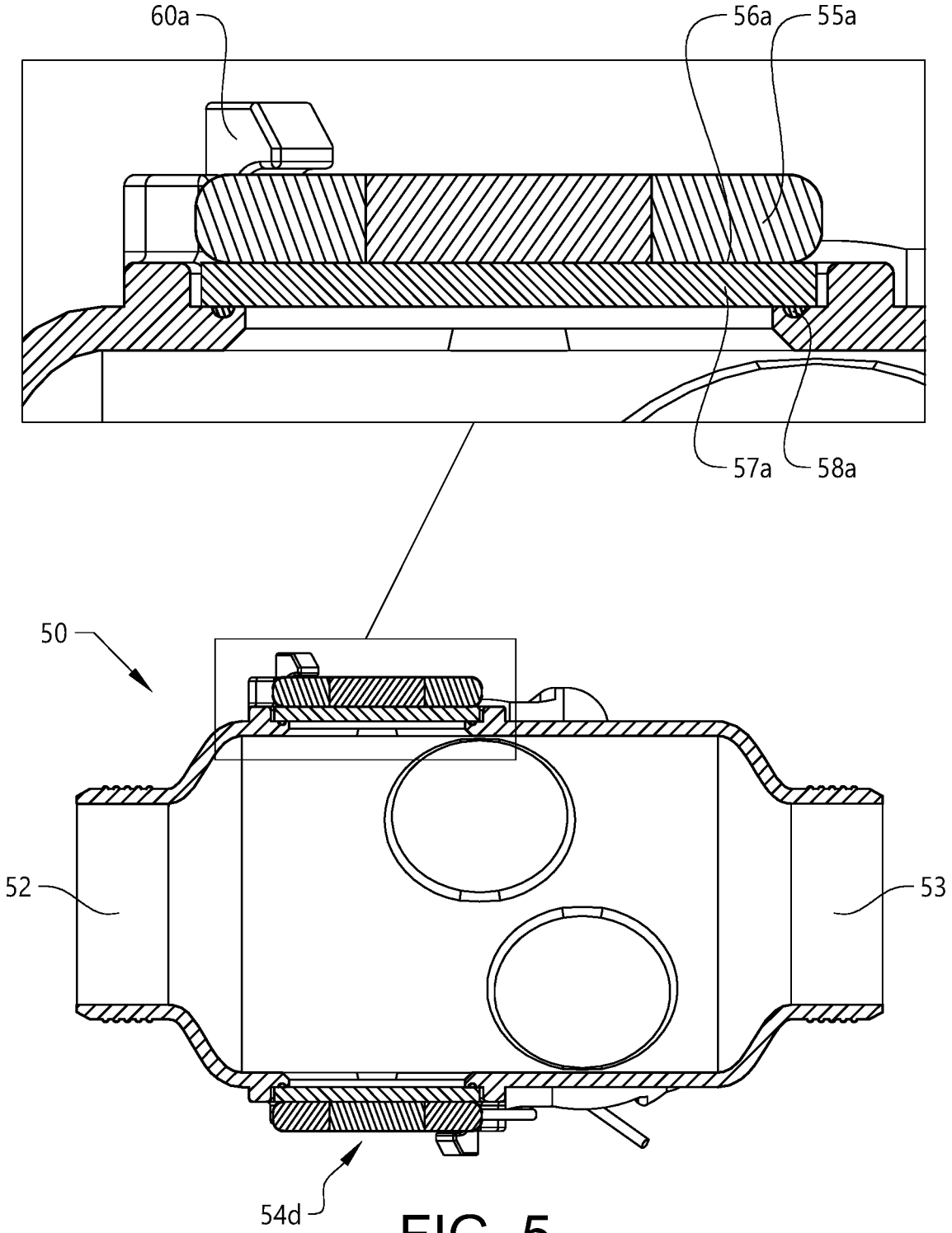
Figure 6:
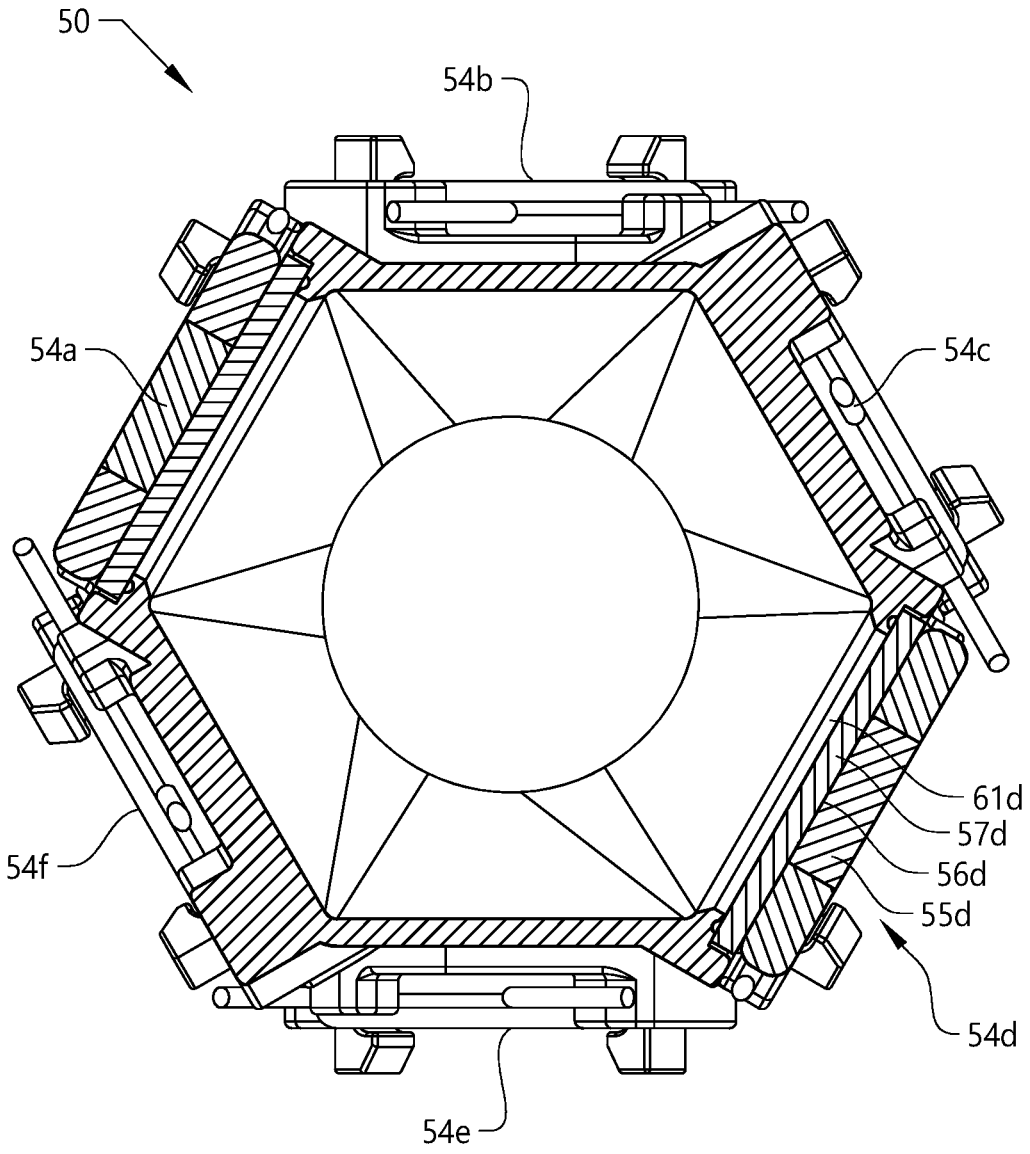

Each UV source/reflector unit 54*a*-54*f*, as exemplified for a first UV source/reflector 54*a* in FIGS. 4 (exploded view) and 5, is arranged in a corresponding opening 61*a* in the wall of the chamber body 51 and comprises a UV-light source 55*a* (with electric connections 59*a*), a UV-light reflector 56*a* in the form of a circular foil of aluminium provided with a central hole 62*a* that forms a UV-transparent zone allowing UV-light from the UV-light source 55*a* to pass through and into the chamber body 51, a cover 57*a* for the opening 61*a*, wherein the cover 57*a* is made of UV transparent quartz glass, and sealing 58*a* in the form of an O-ring for sealing the cover 57*a* around the opening 61*a*. The unit 54*a* is attached to the body 51 by means of snap-fitting element 60*a*. FIG. 5 shows the first UV source/reflector 54*a* put together.

Each UV-light source 55*a* is thus arranged on an outside of the corresponding sealed cover 57*a* and is directed towards the UV-treatment chamber 50 so as to direct the UV-light through the UV-transparent zone 62*a* and into the UV-treatment chamber 50.

Each pair of units 54*a*-54*f* are aligned with each other in an axial direction of the UV-treatment chamber 50 and also directed towards each other so that the UV-light from one unit in a one of pairs pair passes across the UV-treatment chamber 50 and, if not absorbed by the process water inside the chamber 50, hits the reflector of the other unit in the same pair of units. As exemplified in FIG. 6, the UV-light emitted by the UV source 55*a* in the first unit 54*a* hits a corresponding reflector 56*d* of the second unit 54*d* arranged in a corresponding opening 61*d*. Similarly, the UV-light emitted by the UV source 55*d* in the second unit 54*d* hits the reflector 56*a* of the first unit 54*a*.

The UV-light source 55*a* of the first UV source/reflector unit 54*a* may be considered to be "the first UV-light source" and the UV-light reflector 56*d* of the second UV source/reflector unit 54*d* can be considered to be "the first UV-light reflector" and thus it can be said that "the first UV-light source is arranged to direct UV-light towards the first UV-light reflector".

Figure 7:
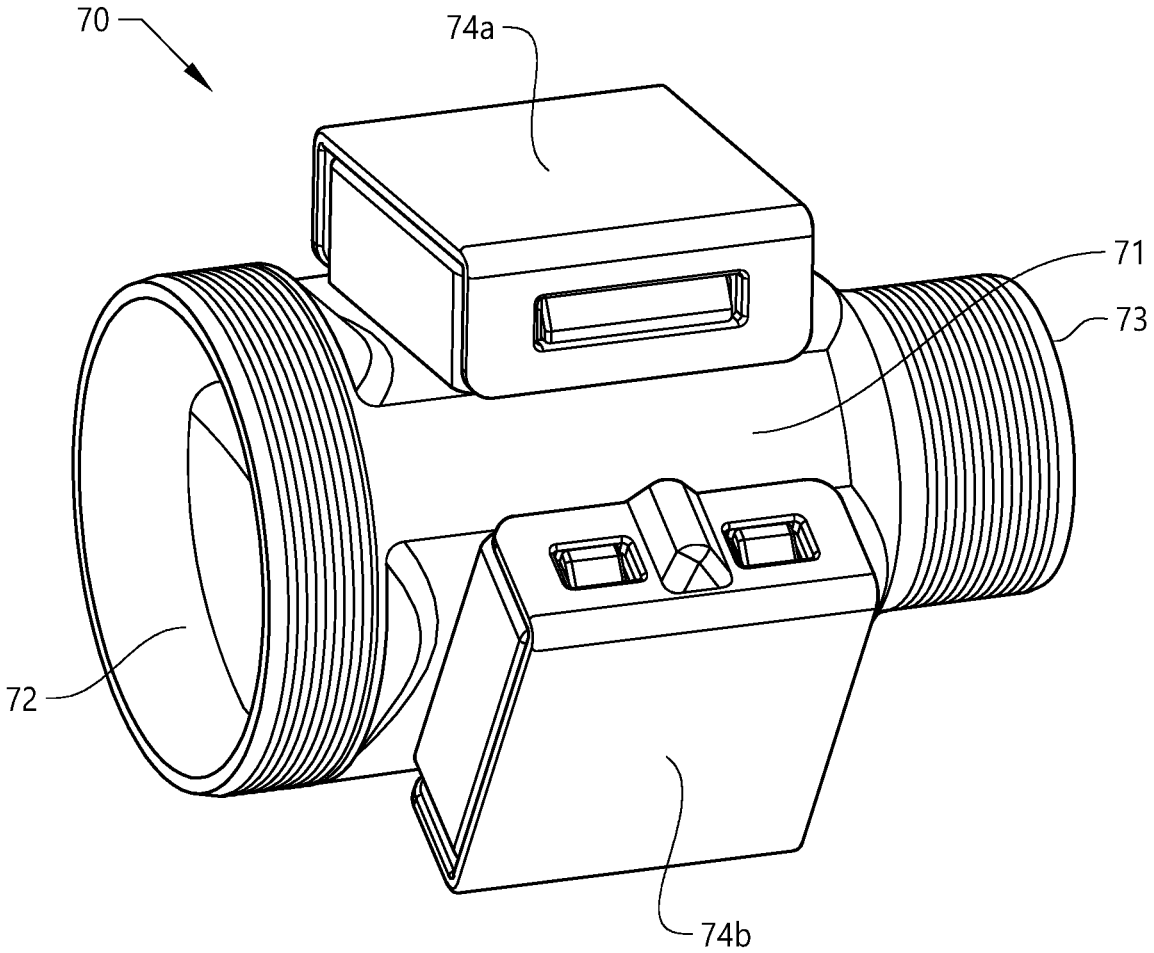
FIGS. 7-8 show a second embodiment of a UV-treatment chamber according to this disclosure.
Figure 8:
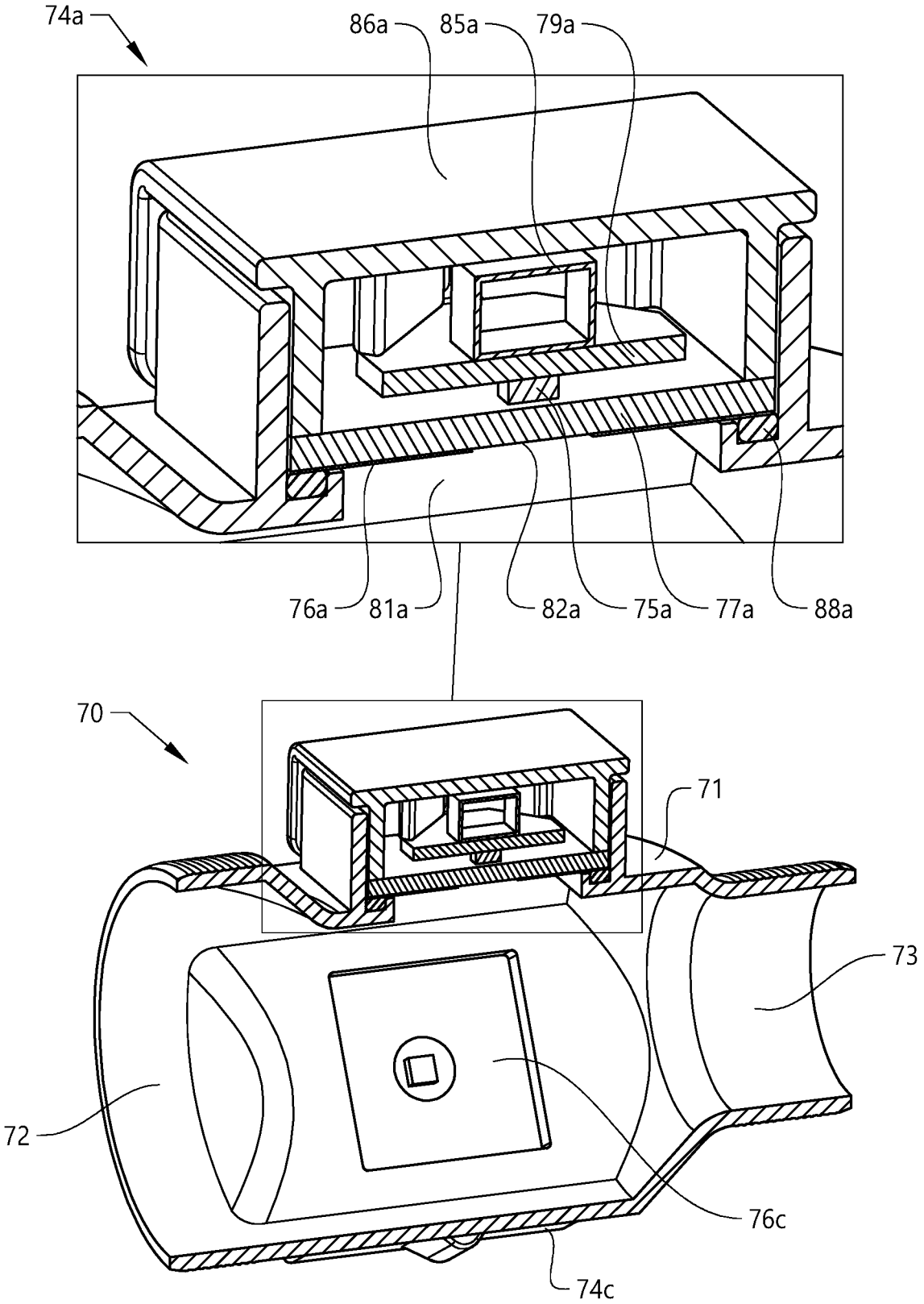

FIGS. 7-8 show a second embodiment of a UV-treatment chamber 70 according to this disclosure. Also in this example the UV-treatment chamber 70 has a water inlet 72, a water outlet 73 and a chamber body 71 through which water flows during operation of the dishwasher 1, 100 (or at least during operation of the recirculation pumps 7 and 21). The chamber body 71 has in this case a circular cross section and is provided with three UV source/reflector units 74*a*-74*c* evenly distributed circumferentially around the chamber body 71. Each unit 74*a*-74*c* emits UV-light in a wide beam so that the UV-light is directed also towards both the two other units. In this case, the units therefore do not have to be arranged in pairs and be located directly opposite each other as in the example described above.

Each UV source/reflector unit 74*a*-74*c*, as exemplified for a first UV source/reflector 74*a* in FIG. 8, is arranged in a corresponding opening 81*a* in the wall of the chamber body 71 and comprises a UV-light source 75*a* arranged on a PCB 79*a* with connector 85*a* and holder/lid 86*a*, a cover 77*a* for the opening 81*a*, wherein the cover 77*a* is made of UV transparent quartz glass, a UV-light reflector 76*a* in the form of a rectangular foil of Teflon provided with a central hole 82*a* that forms a UV-transparent zone allowing UV-light from the UV-light source 75*a* to pass through and into the chamber body 71 (with a wide beam directed also towards the other UV source/reflector units 54*b*, 54*c*), and a sealing 88*a* for sealing the cover 77*a* around the opening 81*a*.

Each UV-light source 75*a* is thus arranged on an outside of the corresponding sealed cover 77*a* and is directed towards the UV-treatment chamber 70 so as to direct the UV-light through the UV-transparent zone 82*a*, i.e. the hole 82*a* in the Teflon foil 76*a*, and into the UV-treatment chamber 70.

The units 74*a*-74*c* are aligned with each other in an axial direction of the UV-treatment chamber 70 (which, however, is not necessary in this case as the beam of UV-light is wide) and also directed towards each other (although not directly towards each other, but sufficiently for the spread of the UV beam) so that the UV-light emitted from one unit passes across the UV-treatment chamber 70 and, if not absorbed by the process water inside the chamber 70, hits the reflector of the other units. As exemplified in FIG. 8, the UV-light emitted by the UV source 75*a* in the first unit 74*a* hits a corresponding reflector 76*c* of another unit 74*c* arranged in a corresponding opening. Similarly, the UV-light emitted by the UV source in the other unit 74*c* hits the reflector 76*a* of the first unit 74*a*.

The UV-light source 55*a* of the first UV source/reflector unit 54*a* may be considered to be "the first UV-light source" and the UV-light reflector 56*d* of the second UV source/reflector unit 54*d* can be considered to be "the first UV-light reflector and thus it can be said that "the first UV-light source is arranged to direct UV-light towards the first UV-light reflector".

Similar to the explanation provided above for first embodiment, any of the UV source/reflector units 74*a*-74*c* can be considered be provided with "the first UV-light source" any of the other UV source/reflector units 74*a*-74*c* can be considered to be provided with "the first UV-light reflector" so that "the first UV-light source is arranged to direct UV-light towards the first UV-light reflector".

The invention is not limited by the embodiments described above but can be modified in various ways within the scope of the claims. For instance, the UV-light sources and reflectors do not necessarily have to be arranged in source/reflector units as described above but may instead form separate components. Further, the number and of sources, reflectors or source/reflector units may be varied as also the relative position between source(s) and reflector(s). The detailed structure of the components may also be modified. As to the household appliance, the dishwasher may be structured in another way than exemplified in FIGS. 1 and 2, and the household appliance may instead be a laundry machine.

The invention claimed is:

1. Household appliance, the household appliance comprising:

a washing chamber for washing of items to be cleaned;

a water system configured to feed water to and from the washing chamber for cleaning and/or rinsing of the items therein;

wherein the water system comprises a UV-treatment chamber for disinfection and/or sterilization of water to be fed to the washing chamber during operation of the household appliance, wherein the UV-treatment chamber is provided with a first UV-light source arranged to direct UV-light towards water present in the UV-treatment chamber, characterized in that the UV-treatment chamber is provided with a first UV-light reflector wherein the first UV-light source is arranged to direct UV-light towards the first UV-light reflector, wherein the first UV-light source and the first UV-light reflector are arranged in relation to each other so that, when UV-light is emitted from the first UV-light source and water is present in the UV-treatment chamber, the UV-light from the first UV-light source passes through the water in the UV-treatment chamber before striking the first UV-light reflector, and wherein the first UV-light reflector is arranged so that the UV-light from the first UV-light source striking the first UV-light reflector is reflected into the water present in the UV-treatment chamber wherein the first UV-light source is arranged in association with a first opening in a wall of the UV-treatment chamber, wherein the first opening is provided with a first sealed cover that at least partly is made of a UV-transparent material and that has an inner side facing the UV-treatment chamber and an outer side facing away from the UV-treatment chamber, wherein at least a part of the first sealed cover exhibits a UV-transparent zone, and wherein the first UV-light source is arranged on an outside of the first sealed cover and directed towards the UV-treatment chamber so as to direct the UV-light through the UV-transparent zone and into the UV-treatment chamber wherein the first UV-light reflector is arranged in association with a second opening in a wall of the UV-treatment chamber, wherein the second opening is provided with a second sealed cover and wherein the UV-treatment chamber is provided with a second UV-light reflector in addition to the first UV-light reflector, wherein the second UV-light reflector is arranged in association with the first UV-light source at the first opening, and wherein the second UV-light reflector is arranged on the outside or an inside of the UV-transparent material of the first sealed cover around or at a side of the UV-transparent zone so as to, while still allowing UV-light from the first UV-light source to pass through the UV-transparent zone and into the UV-treatment chamber, allow UV-light directed towards the first opening to be reflected back into the UV-treatment chamber.

2. Household appliance according to claim 1, wherein the first UV-light reflector is arranged on an inside of the second sealed cover so as to reflect UV-light before it reaches the second sealed cover.

3. Household appliance according to claim 1, wherein the second sealed cover is at least partly made of a UV-transparent material, and wherein the first UV-light reflector is arranged on an outside of the UV-transparent material so as to allow UV-light directed towards the second opening to pass through the UV-transparent material, reflect onto the first UV-light reflector and pass back through the UV-transparent material into the UV-treatment chamber.

4. Household appliance according to claim 1, wherein the UV-light reflector is made of aluminium.

5. Household appliance according to claim 1, wherein the UV-light reflector is made of Teflon.

6. Household appliance according to claim 1, wherein the UV-transparent material is quartz glass.

7. Household appliance according to claim 1, wherein the UV-light source is configured to emit UV-light within a range that at least partly includes wavelengths between 100-280 nm (UV-C).

8. Household appliance according to claim 1, wherein the UV-treatment chamber forms a through-flow conduit for water.

9. Household appliance according to claim 8, wherein the first UV-light source is arranged at a wall of the UV-treatment chamber so as to direct UV-light into the UV-treatment chamber in a direction across a flow direction of the water when the water flows through the UV-treatment chamber.

10. Household appliance according to claim 8, wherein also the first UV-light reflector is arranged at the wall of the UV-treatment chamber but displaced in relation to the first UV-light source with regard to a circumference of the UV-treatment chamber so that, when UV-light is emitted from the first UV-light source and water flows through the UV-treatment chamber, the UV-light from the first UV-light source passes through the water across the flow direction thereof before striking the first UV-light reflector.

11. Household appliance according to claim 1, wherein the water system comprises a recirculation system for recirculating of water to be fed to the washing chamber during operation of the household appliance, wherein the UV-treatment chamber is arranged in said recirculation system.

12. Household appliance according to claim 11, wherein the recirculation system is arranged to recirculate water from the washing chamber and back to the washing chamber.

13. Household appliance according to claim 11, wherein the water system comprises a tank for storage of incoming fresh water and/or water coming from the washing chamber, wherein the recirculation system is arranged to recirculate water from the tank and back to the tank.

14. Household appliance according to claim 1, wherein the household appliance comprises a fresh water inlet and an outlet for used water, both of which being connected to the water system.

15. Household appliance according to claim 1, wherein the household appliance is a dishwasher machine.

16. Household appliance according to claim 1, wherein the household appliance is provided with a turbidity sensor arranged to sense a turbidity of water present, or water to be present or water that has been present, in the UV-treatment chamber during operation of the household appliance.

17. Method for operating a household appliance according to claim 16, the method comprising:

operating the household appliance with the first UV-light source activated;

receiving a signal from the turbidity sensor;

determining, based on the turbidity sensor signal, whether the turbidity is above a threshold; and if the turbidity is above the threshold: deactivating the first UV-light source and/or control the water system so as to lower the turbidity in the water present or to be present in the UV-treatment chamber.

* * * * *